US007029614B2

(12) United States Patent
Tanaka et al.

(10) Patent No.: US 7,029,614 B2
(45) Date of Patent: Apr. 18, 2006

(54) METHOD OF MAKING A MULTI-PIECE SOLID GOLF BALL

(75) Inventors: Hiroaki Tanaka, Kobe (JP); Yoshiyuki Okido, Kobe (JP); Hideki Sano, Kobe (JP)

(73) Assignee: Sumitomo Rubber Industries, Ltd., Hyogo-Ken (JP)

( * ) Notice: Subject to any disclaimer, the term of this patent is extended or adjusted under 35 U.S.C. 154(b) by 493 days.

(21) Appl. No.: 09/916,511

(22) Filed: Jul. 30, 2001

(65) Prior Publication Data

US 2002/0002085 A1 Jan. 3, 2002

Related U.S. Application Data

(62) Division of application No. 09/154,632, filed on Sep. 17, 1998, now abandoned.

(30) Foreign Application Priority Data

Sep. 18, 1997 (JP) ..... 9-253328

(51) Int. Cl.
*B29C 43/18* (2006.01)

(52) U.S. Cl. ..... 264/248; 264/250; 264/255; 264/279.1

(58) Field of Classification Search ..... 264/250, 264/279.1, 248, 255
See application file for complete search history.

(56) References Cited

U.S. PATENT DOCUMENTS

| | | | | |
|---|---|---|---|---|
| 2,287,270 | A * | 6/1942 | Partridge | 156/245 |
| 3,784,209 | A * | 1/1974 | Berman et al. | 473/377 |
| 4,848,770 | A * | 7/1989 | Shama | 473/373 |
| 6,036,907 | A * | 3/2000 | Tanaka et al. | 264/250 |
| 6,071,201 | A * | 6/2000 | Maruko | 473/373 |
| 6,213,895 | B1 * | 4/2001 | Sullivan et al. | 473/374 |

* cited by examiner

*Primary Examiner*—Edmund H. Lee
(74) *Attorney, Agent, or Firm*—Birch, Stewart, Kolasch & Birch, LLP

(57) ABSTRACT

The present invention provides a multi-piece solid golf ball having excellent flight performance and excellent shot feel at the time of hitting, and a method of making the same having good workability. The present invention relates to a multi-piece solid golf ball comprising a core composed of a center and at least one core outer layer formed on the center, and a cover covering the core, wherein the core outer layer is formed from a rubber composition which does not contain zinc salt of unsaturated carboxylic acid.

5 Claims, 4 Drawing Sheets

METHOD OF MAKING A MULTI-PIECE SOLID GOLF BALL

This application is a divisional of application Ser. No. 09/154,632, filed on Sep. 17, 1998, now abandoned, the entire contents of which are hereby incorporated by reference and for which priority is claimed under 35 U.S.C. § 120; and this application claims priority of Application No. 9-253328 filed in Japan on Sep. 18, 1997 under 35 U.S.C. § 119.

FIELD OF THE INVENTION

The present invention relates to a multi-piece solid golf ball and a method of making the same. More particularly, it relates to a multi-piece solid golf ball having excellent flight performance and excellent shot feel at the time of hitting, and a method of making the same having good workability.

BACKGROUND OF THE INVENTION

Golf balls are typically classified into thread wound golf balls and solid golf balls. The solid golf ball is generally composed of a core and a cover covering the core. Although the core can have either single layer structure or multi-layer structure, the core is generally formed from vulcanized rubber. The vulcanized rubber is obtained by vulcanizing or press-molding a rubber composition, which typically comprises high-cis polybutadiene rubber, zinc salt of (meth) acrylic acid, organic peroxide as a crosslinking agent and the other additives. The zinc salt of (meth) acrylic acid acts as a co-crosslinking agent to form crosslinkage through the zinc salt of (meth) acrylic acid between rubber molecules, in addition to crosslinkage through oxygen atoms generated by peroxide between rubber molecules. These two types of crosslinkage enhance flight performance and improve shot feel at the time of hitting of the resulting golf ball. The term "(meth) acrylic acid" as used herein refers to acrylic acid or methacrylic acid, or the mixture thereof.

It has been general that both core and cover have single layer structure, but it is now proposed that the core or cover are made multi-layer structure, which has two or more layers, in order to extend flight distance and improve shot feel. It is, however, difficult to make the core multi-layer structure, particularly two layer structure composed of a center and a core outer layer, because it is required to cover a rubber composition having high viscosity in concentric circle on the center and vulcanize or press-mold it. Methods of producing a two-layered core include, for example, (A) a method comprising the steps of vulcanizing or press-molding a rubber composition for center to obtain a center, holding the center to a given position in a mold for a core outer layer with a movable hold pin, removing the pin, and then vulcanizing or press-molding the core outer layer, (B) a method comprising the steps of semi-vulcanizing a rubber composition for core outer layer or heating the rubber composition for a given time to such a degree that the rubber composition does not shrink using a mold having a semi-spherical cavity and a male plug mold to form a semi-vulcanized or unvulcanized semi-spherical half-shell for the core outer layer, removing the male plug mold, putting the vulcanized center in the semi-spherical half-shell for the core outer layer, covering the center with two half-shells, and then vulcanizing or press-molding it, (C) a method described in the method (B) except that the core outer layer is used as a seat without making the core outer layer the half-shell.

The above are described in Japanese Patent Kokai Publication Nos. 105774/1988, 228978/1990, 218077/1994 and the like. The methods also include;

(D) a method described in the method (B) except that the unvulcanized center is covered with two semi-vulcanized or vulcanized semi-spherical half-shells for core outer layer to vulcanize or integrally press-mold it without vulcanizing the center in advance, (E) a method comprising the steps of covering the molded center with an unvulcanized core outer layer, and molding it in a mold having a different shape from the mold for vulcanizing or press-molding the core outer layer in a desired shape when forming the core outer layer, and (F) a method comprising the steps of covering the center with the core outer layer in two stages, comprising the first stage of forming an intermediate article having a Rugby ball shape using a mold having an ellipse cavity having a shorter diameter slightly larger than the outer diameter of the center and a longer diameter equal to the diameter of the core outer layer, and the second stage of putting the longer diameter of the intermediate article on the seam surface in a mold for core to cover the intermediate article with the core outer layer. This method (F) is based on the fact that the eccentricity of the center in the core mainly occurs at the seam surface of the core outer layer.

In the above methods, it is required to use a great quantity of fluororesin type or silicone resin type release agent, or to carry out a special release treatment on a mold surface, such as chrome plating or fluororesin coating, because the releasability of the molded article from the mold is very poor when molding a rubber composition containing zinc acrylate and high-cis polybutadiene.

In case of using the release agent, the release agent usually remains on the surface of the molded article and the adhesion between the center and the core outer layer or that between the core outer layer and the cover is degraded by the presence of the remaining release agent. Accordingly, it is required to remove the release agent by means of buffing or washing. The removal of the release agent remaining in a concave portion of the molded article is very difficult. The special release treatment, such as chrome plating or fluororesin coating is better because the release agent is not adhered to the molded article. The special treatment, however, has a defect that operation is complicated and requires high cost. There has been proposed a release agent that is not adhered to the molded article, but the coating operation is complicated and it is expensive.

OBJECTS OF THE INVENTION

A main object of the present invention is to provide a multi-piece solid golf ball having excellent flight performance and excellent shot feel at the time of hitting, and a method of making the same having good workability.

According to the present invention, the object described above has been accomplished by making a multi-piece solid golf ball comprising a core 4 consisting of a center 1 and one or more layers of core outer layer 2 formed on the center, and a cover 3 covering the core, the core outer layer 2 being obtained from a rubber composition which does not contain zinc salt of unsaturated carboxylic acid, which has been typically used as a co-crosslinking agent for cores of golf balls, thereby providing a multi-piece solid golf ball having excellent flight performance and excellent shot feel, and a method of making the same having good workability.

This object as well as other objects and advantages of the present invention will become apparent to those skilled in the art from the following description with reference to the accompanying drawings.

DETAILED DESCRIPTION OF THE INVENTION

The present invention provides a multi-piece solid golf ball comprising a core composed of a center and a core outer layer formed on the center, and a cover covering the core, wherein the core outer layer is formed from a rubber composition which does not contain a zinc salt of an unsaturated carboxylic acid.

The present invention provides a method of making a multi-piece solid golf ball comprising the steps of:

(a) molding a rubber composition for a center in a spherical shape to form an unvulcanized rubber center, (b) placing a rubber composition for a core outer layer to a mold having a semi-spherical cavity, and either semi-vulcanizing the rubber composition or heating the rubber composition to such a degree that the rubber composition neither semi-vulcanizes nor shrinks between the semi-spherical cavity and a male plug mold to form a semi-vulcanized or unvulcanized semi-spherical half-shell for the core outer layer, (c) after removing the male plug mold, mounting the unvulcanized center formed in the step (a) on a concave of the semi-vulcanized or unvulcanized semi-spherical half-shell for the core outer layer, and covering the unvulcanized center with a semi-vulcanized or unvulcanized semi-spherical half-shell for the core outer layer separately formed in the same manner as the step (b) to integrally vulcanize, (d) optionally, repeating the step (c) to form a core, and (e) covering the core with a cover, wherein the rubber composition for core outer layer does not contain zinc salt of unsaturated carboxylic acid.

Figure 1:
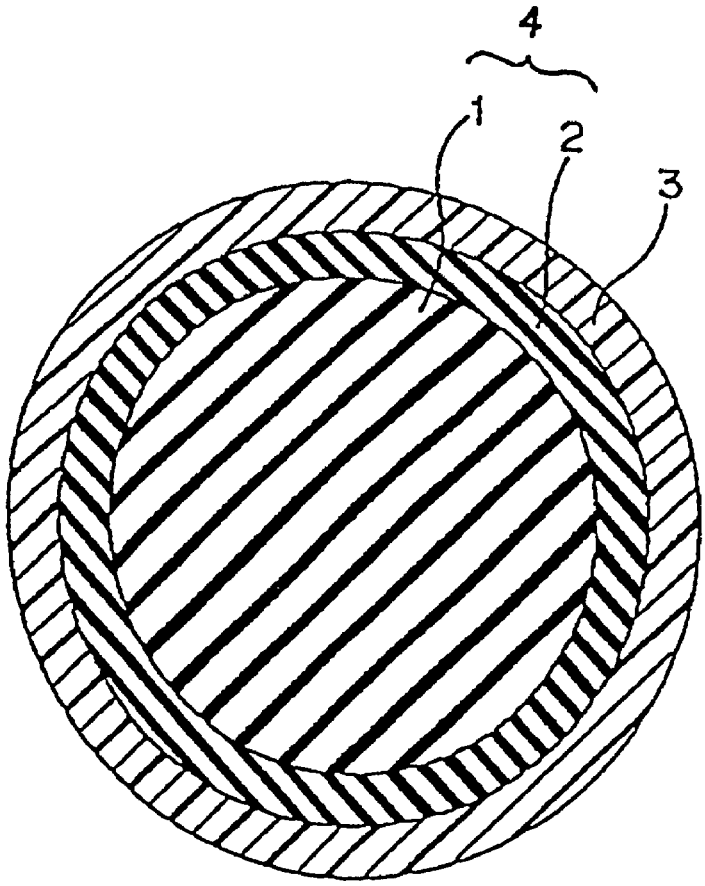
FIG. 1 is a schematic cross section illustrating one embodiment of the golf ball of the present invention.

The multi-piece solid golf ball of the present invention will be explained taking a three-piece solid golf ball having a two-layered core with reference to the accompanying drawings. FIG. 1 is a schematic cross section illustrating one embodiment of the multi-piece solid golf ball of the present invention. In FIG. 1, 1 is a center, 2 is a core outer layer formed on the center and 3 is a cover covering the core outer layer 2.

Figure 2:
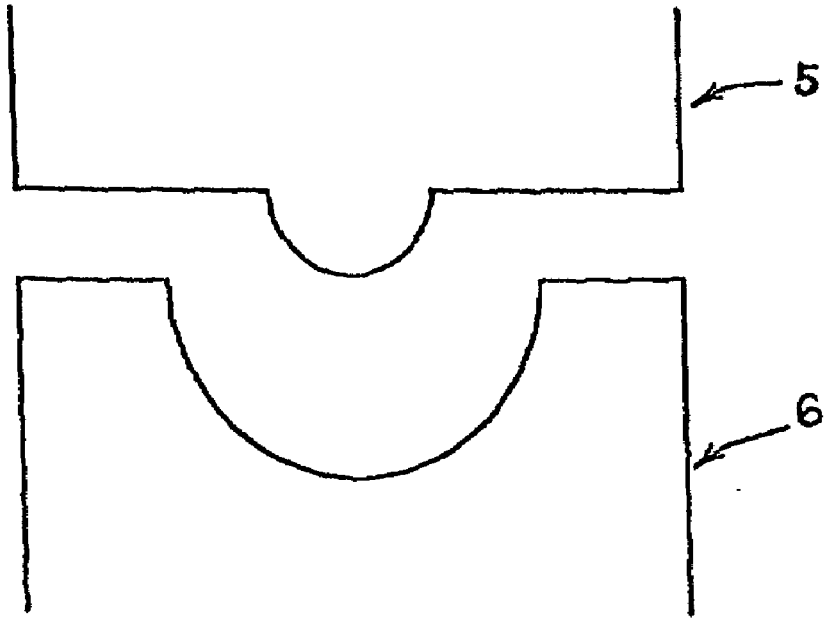
FIG. 2 is a schematic cross section illustrating one embodiment of the mold for producing the core outer layer of the golf ball of the present invention.
Figure 3:
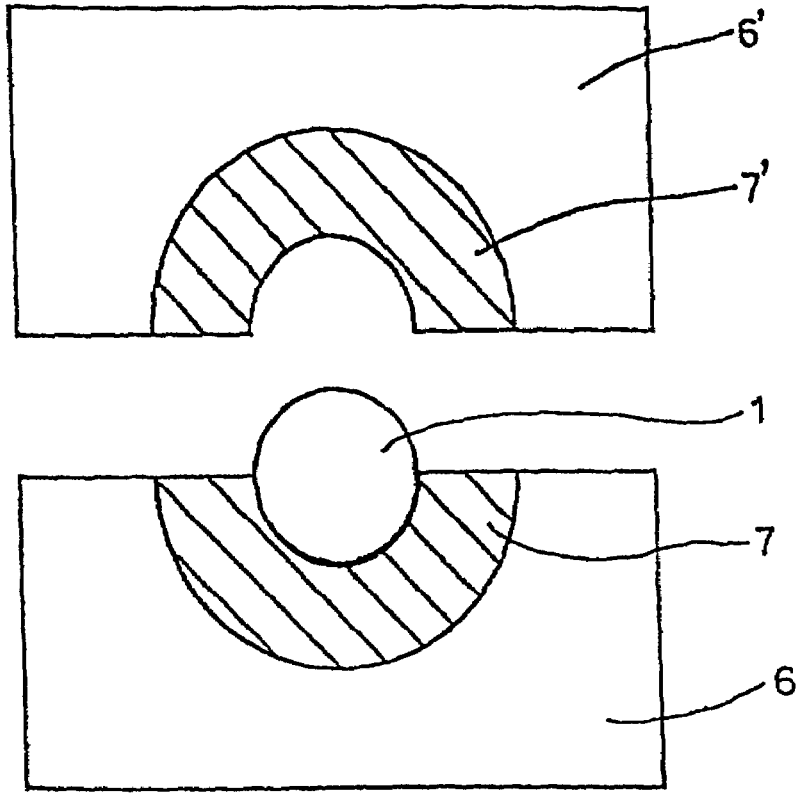
FIG. 3 is a schematic cross section illustrating one embodiment of the mold for producing the core of the golf ball of the present invention.

FIG. 2 is a schematic cross section illustrating one embodiment of the mold for producing the core outer layer of the golf ball of the present invention. FIG. 3 is a schematic cross section illustrating one embodiment of the mold for producing the core of the golf ball of the present invention. In the method of making the multi-piece solid golf ball of the present invention, a rubber composition for a core outer layer 7 is placed in a mold having a semi-spherical cavity 6, and either semi-vulcanized or heated to such a degree that the rubber composition neither semi-vulcanizes nor shrinks between the semi-spherical cavity and a male plug mold 5 as described in FIG. 2 to form a semi-vulcanized or unvulcanized semi-spherical half-shell for the core outer layer. After removing the male plug mold 5, the unvulcanized center 1 is mounted on a concave of the semi-vulcanized or unvulcanized semi-spherical half-shell for the core outer layer 7 as described in FIG. 3, and a semi-vulcanized or unvulcanized semi-spherical half-shell for the core outer layer 7', separately formed in the same manner, is covered on the unvulcanized center, and integrally vulcanized to form a two-layered core 4. The core 4 is covered with the cover 3 to obtain a three-piece golf ball.

The term "semi-vulcanized" as used herein refers to a state wherein a rubber composition is vulcanized but vulcanization stops before the crosslinking reaction is completely finished. The semi-vulcanized article can keep its molded shape, and can be further vulcanized to complete the crosslinking reaction when heating again. The semi-vulcanization may be preferably adjusted to a condition that when a torque is measured by a curastometer, the difference between a minimum torque value immediately after starting vulcanization and a maximum torque value when the vulcanization is completed is controlled within the range of 5 to 80%.

Figure 4:
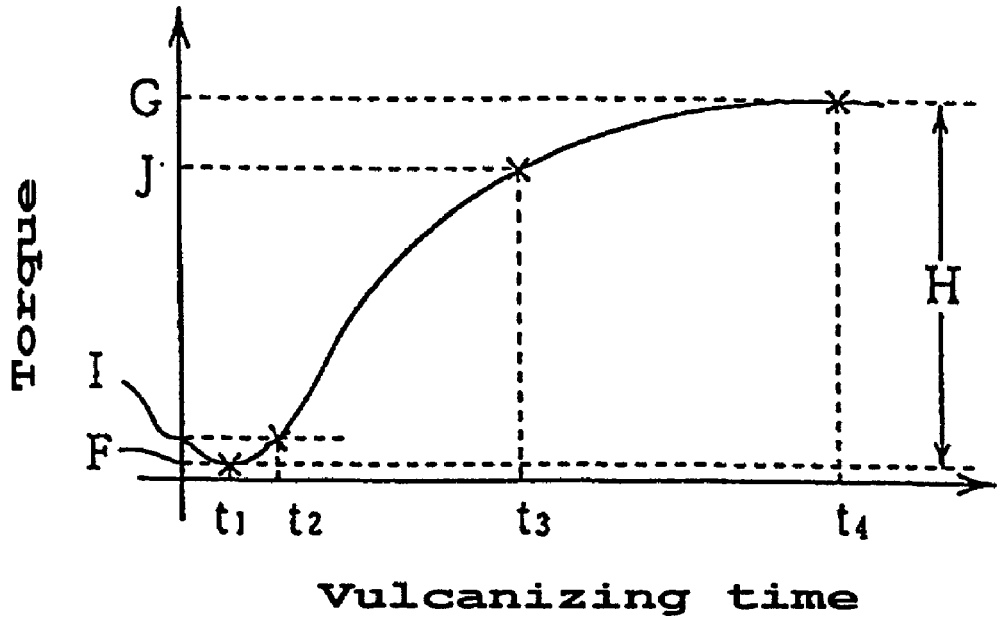
FIG. 4 is a graphic illustration showing the relationship between the torque measured by a curastometer of the rubber composition of the present invention and time.

A method of adjusting the condition of semi-vulcanization is as follows. The change or torque with time applied to a disc of the curastometer with time is measured from the unvulcanized state to the completely vulcanized state of the rubber composition. FIG. 4 is a graphic illustration showing the relation of a torque measured using a curastometer (JSR curastometer type III D manufactured by Orientech Co., Ltd.) from the unvulcanized state to the completely vulcanized state of the rubber composition with time. The larger the torque, the harder the rubber, because vulcanization is proceeded. The minimum torque value F appears at the time $t_1$ immediately after starting the vulcanization, the torque gradually increases thereafter, and the maximum torque value C appears at the time $t_4$ when the vulcanization is completed. In the present invention, the semi-vulcanized state means that when the torque is measured by a curastometer, a difference H between the minimum torque value F and the maximum torque value G is controlled within the range of 5 to 80%. If a torque I corresponding to 5% of the difference H appears at the time $t_3$ and a torque J corresponding to 80% of the difference H appears at the time $t_4$, the semi-vulcanized state is obtained when vulcanization stops at a time between the time $t_3$ and the time $t_4$. The measurement by the curastometer is conducted according to JIS K 6300, except that it is conducted at a testing temperature of 160° C. (it can be measured between 150 and 170° C.) and an angle of amplitude of the disc of 3°.

In the multi-piece solid golf ball of the present invention, the rubber composition containing no zinc acrylate is used for the core outer layer 2, because the rubber composition containing zinc acrylate has very poor releasability from a mold. It is required that the rubber composition for the center 1 contains zinc acrylate for keeping rebound characteristics good in the resulting golf ball, thereby releasability is poor. However, since the center 1 has a shape that release agent is easily removed from its surface after vulcanization, the center 1 can be produced in the same manner as the conventional two-piece golf ball. Therefore, a multi-piece solid golf ball having good workability, excellent flight performance and good shot feel at the time of hitting is obtained.

Both the center 1 and the core outer layer 2 are obtained by vulcanizing or press-molding a rubber composition. The rubber composition typically comprises a base rubber, a crosslinking agent, a co-crosslinking agent, optionally a filler and antioxidant, and the like. As a co-crosslinking agent, zinc acrylate is used for the center 1, and a metal salt or an ester of unsaturated carboxylic acid other than zinc salt of unsaturated carboxylic acid is used for the core outer layer 2.

The base rubber used for the center 1 of the present invention may be natural rubber and/or synthetic rubber which has been conventionally used for solid golf balls. Preferred is high-cis polybutadiene rubber containing a cis-1, 4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like.

The crosslinking agent used for the center 1 of the present invention includes organic peroxide, for example, dicumyl peroxide, t-butyl peroxide and the like. Preferred is dicumyl peroxide. An amount of the crosslinking agent is from 0.5 to 3.0 parts by weight, based on 100 parts by weight of the base rubber. When the amount of the crosslinking agent is smaller than 0.5 parts by weight, the center is too soft. Therefore, rebound characteristics are degraded to reduce flight distance. On the other hand, when the amount of the crosslinking agent is larger than 3.0 parts by weight, the center is too hard, thus shot feel is poor.

The co-crosslinking agent used for the center 1 of the present invention includes metal salt of unsaturated carboxylic acid, particularly mono or divalent metal salts, such as zinc or magnesium salts of α, β-unsaturated carboxylic acids having 3 to 8 carbon atoms (e.g. acrylic acid, methacrylic acid, etc.). Preferred co-crosslinking agent is zinc acrylate because it imparts high rebound characteristics to the resulting golf ball. An amount of the co-crosslinking agent in the rubber composition is from 15 to 40 parts by weight, preferably from 20 to 35 parts by weight. When the amount of the co-crosslinking agent is larger than 40 parts by weight, the center is too hard, thus shot feel is poor. On the other hand, when the amount of the co-crosslinking agent is smaller than 15 parts by weight, the center is soft. Therefore, rebound characteristics are degraded to reduce flight distance.

The filler used for the center 1 of the present invention, which can be typically used for the center of golf ball, includes for example, inorganic filler (such as zinc oxide, barium sulfate, calcium carbonate and the like), high specific gravity metal powder filler (such as powdered tungsten, powdered molybdenum, and the like), and the mixture thereof. An amount of the filler is not limited and can vary depending on the specific gravity and size of the cover and center, but is from 3 to 70 parts by weight, preferably from 3 to 60 parts by weight, based on 100 parts by weight of the base rubber. When the amount of the filler is smaller than 3 parts by weight, the center is too light, and thus the resulting golf ball is too light. On the other hand, when the amount of the filler is larger than 70 parts by weight, the center is too heavy, and the resulting golf ball is too heavy.

The rubber composition for the center 1 of the golf ball of the present invention can contain other components, which have been conventionally used for preparing the center of solid golf balls, such as peptizing agent or antioxidant. If used, an amount of the antioxidant is preferably 0.2 to 1.5 parts by weight, based on 100 parts by weight of the base rubber.

The above rubber composition for the center is molded in a spherical to form an unvulcanized center 1. A core outer layer 2 is then formed on the center 1.

The base rubber used for the core outer layer 2 of the present invention may be natural rubber and/or synthetic rubber which has been conventionally used for solid golf balls. Preferred is high-cis polybutadiene rubber containing a cis-1, 4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like. In the core outer layer 2, it is preferable that the base rubber comprises not less than 80% by weight of polybutadiene rubber containing a cis-1, 4 bond of not less than 80%, in view of rebound characteristics of the resulting golf ball.

The crosslinking agent used for the core outer layer 2 of the present invention includes organic peroxide, for example, dicumyl peroxide, t-butyl peroxide and the like. Preferred is dicumyl peroxide. An amount of the crosslinking agent is from 0.5 to 5.0 parts by weight, based on 100 parts by weight of the base rubber. When the amount of the crosslinking agent is smaller than 0.5 parts by weight, the core outer layer is too soft. Therefore, rebound characteristics are degraded to reduce flight distance. On the other hand, when the amount of the crosslinking agent is larger than 5.0 parts by weight, the core outer layer is too hard, thus shot feel is poor.

The co-crosslinking agent used for the core outer layer 2 of the present invention includes metal salt of unsaturated carboxylic acid other than zinc salt of unsaturated carboxylic acid, particularly sodium, magnesium, calcium, tin, titanium or zirconium salts of α, β-unsaturated carboxylic acids having 3 to 8 carbon atoms (e.g. acrylic acid, methacrylic acid, etc.). Preferred co-crosslinking agent is magnesium acrylate because it imparts high rebound characteristics to the resulting golf ball. The co-crosslinking agent used for the core outer layer 2 of the present invention also includes esters of unsaturated carboxylic acids, such as methyl ester, ethyl ester or propyl ester of unsaturated carboxylic acids (e.g. acrylic acid, methacrylic acid, ethacrylic acid, crotonic acid, sorbic acid, itaconic acid, maleic acid, fumaric acid, etc.); trimethylolpropane trimethacrylate and the like. An amount of the co-crosslinking agent in the rubber composition is from 5 to 50 parts by weight, preferably from 10 to 40 parts by weight, based on 100 parts by weight of the base rubber. When the amount of the co-crosslinking agent is larger than 50 parts by weight, the core outer layer is too hard, and thus shot feel is poor. On the other hand, when the amount of the co-crosslinking agent is smaller than 5 parts by weight, the core outer layer is too soft. Therefore, rebound characteristics are degraded to reduce flight distance.

The filler used for the core outer layer 2 of the present invention, which can be typically used for the center of golf ball, includes for example, inorganic filler (such as zinc oxide, barium sulfate, calcium carbonate and the like), high specific gravity metal powder filler (such as powdered tungsten, powdered molybdenum, and the like), and a mixture thereof. An amount of the filler is not limited and can vary depending on the specific gravity and size of the cover and core outer layer, but is from 3 to 70 parts by weight, based on 100 parts by weight of the base rubber. When the amount of the filler is smaller than 3 parts by weight, the core outer layer is too light, thus the resulting golf ball is too light. On the other hand, when the amount of the filler is larger than 70 parts by weight, the core outer layer is too heavy, thus the resulting golf ball is too heavy.

The rubber composition for the core outer layer 2 of the golf ball of the present invention can contain other components, which have been conventionally used for preparing the center of solid golf balls, such as peptizing agent or antioxidant. If used, an amount of the antioxidant is preferably 0.2 to 1.5 parts by weight, based on 100 parts by weight of the base rubber.

The core outer layer 2 is formed by the method comprising the steps of: (i) placing a rubber composition for the core outer layer to a mold having a semi-spherical cavity 6, and then either semi-vulcanizing or heating to such a degree that the rubber composition neither semi-vulcanizes nor shrinks between the semi-spherical cavity and a male plug mold 5 as described in FIG. 2 to form a semi-vulcanized or unvulcanized semi-spherical half-shell for the core outer layer, and (ii) after removing the male plug mold 5, mounting the unvulcanized center on a concave of the semi-vulcanized or unvulcanized semi-spherical half-shell for the core outer layer as described in FIG. 3, covering a separate semi-vulcanized or unvulcanized semi-spherical half-shell for the core outer formed in the same manner on the unvulcanized center, and integrally vulcanizing. The core outer layer 2 may have a multi-layered structure, which has two or more layers, by optionally repeating the step (ii).

In the multi-piece solid golf ball of the present invention, the center has a diameter of 15 to 40 mm, preferably 25 to 39 mm. When the diameter of the center is smaller than 15 mm, the volume of the center is too small, thus the technical effects accomplished by the presence of the core are not obtained. On the other hand, when the diameter of the center is larger than 40 mm, the thickness of the core outer layer is too thin, thus technical effects accomplished by the presence of the core outer layer are not obtained. The core preferably has a diameter of 35 to 41 mm, and therefore the core outer layer has a thickness of 0.5 to 13 mm, preferably 0.5 to 10 mm, because the center has the diameter of 15 to 40 mm as described above. When the thickness of the core outer layer is smaller than 0.5 mm, the thickness of the core outer layers is too thin, thus technical effects accomplished by the presence of the core outer layer are not obtained. On the other hand, when the thickness of the core outer layer is larger than 13 mm, the volume of the center is too small, thus the technical effects accomplished by the presence of the core are not obtained. The volume of the core outer layer 2 is preferably less than 50% of the volume of the core 4, in view of durability and rebound characteristics.

The cover 3 is then covered on the core outer layer 2. In the golf ball of the present invention, the cover may be formed from ionomer resin or the mixture of thereof. The ionomer resin is an ethylene-(meth) acrylic acid copolymer, of which a portion of carboxylic acid groups is neutralized with metal ion, which has been conventionally used for preparing the cover of solid golf balls. The metal ion which neutralizes a portion of carboxylic acid groups of the copolymer includes alkali metal ion, such as sodium ion, potassium ion, lithium ion and the like; divalent metal ion, such as zinc ion, calcium ion, magnesium ion, and the like; trivalent metal ion, such as aluminum ion, neodymium ion, and the like; and the mixture thereof. Preferred are sodium ion, zinc ion, lithium ion and the like, in view of rebound characteristics, durability and the like. The ionomer resin is not limited, but examples thereof will be shown by a trade name thereof. Examples of the ionomer resins, which is commercially available from Mitsui Du Pont Polychemical Co., include Hi-milan 1557, Hi-milan 1605, Hi-milan 1652, Hi-milan 1705, Hi-milan 1706, Hi-milan 1707, Hi-milan 1855 and Hi-milan 1856. Examples of the ionomer resins, which is commercially available from Exxon Chemical Co., include Iotec 7010, Iotec 8000, and the like. These ionomer resins are used alone or in combination.

The cover composition used in the present invention may optionally contain pigments (such as titanium dioxide, etc.), fillers (such as barium sulfate, etc.) and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover. An amount of the pigment is preferably from 0.1 to 0.5 parts by weight based on 100 parts by weight of the cover resin component.

The cover used in the present invention is formed by a conventional method for forming golf ball cover well known in the art, such as injection molding, press-molding and the like. The cover preferably has a thickness of 1.0 to 4.0 mm. At the time of cover molding, many depressions called "dimples" may be optionally formed on the surface of the golf ball. Furthermore, paint finishing or marking stamp may be optionally provided after cover molding for serving commercial sell.

EXAMPLES

The following Examples and Comparative Examples further illustrate the present invention in detail but are not to be construed to limit the scope of the present invention.

Examples 1 to 5 and Comparative Examples 1 to 2

Production of Two-Layered Core

The core outer layer compositions shown in Table 1 were mixed, and press-molded at 150° C. for 5 minutes using a male plug mold 5 and a mold having a semi-spherical cavity 6 described in FIG. 2 to obtain a semi-spherical half-shell for the core outer layer 2. The core outer layer was left in the mold having a semi-spherical cavity after removing the male plug mold. The center rubber composition shown in Table 2 were mixed, and molded to form an unvulcanized center 1. The unvulcanized center was covered with the two core outer layers, and vulcanized or integrally press-molded at 165° C. for 8 minutes to obtain a two-layered core 4 having a diameter of 38.5 mm.

TABLE 1

(parts by weight)

| Core outer layer | Example No. | | | | | Comparative Example No. | |
|---|---|---|---|---|---|---|---|
| composition | 1 | 2 | 3 | 4 | 5 | 1 | 2 |
| BR-01 *1 | 100 | 90 | 80 | 100 | 100 | 100 | 90 |
| IR2200 *2 | — | 10 | 20 | — | — | — | 10 |
| Methacrylic acid | 30 | 30 | — | 20 | — | — | 30 |
| Magnesium oxide | 30 | — | — | 20 | — | — | — |
| Calcium hydroxide | — | 30 | — | — | — | — | — |
| Magnesium acrylate | — | — | 45 | — | — | — | — |
| Zinc acrylate | — | — | — | — | — | 30 | — |
| Trimethylolpropane trimethacrylate | — | — | — | — | 30 | — | — |
| Zinc oxide | — | — | — | — | 15 | 15 | 30 |
| Barium sulfate | 10 | — | — | 15 | — | — | — |
| Dicumyl peroxide | 2 | — | 2 | 2 | 4 | 1.5 | 1 |
| Core outer layer/ core (% by volume) | 23 | 40 | 40 | 10 | 23 | 23 | 23 |

*1: High-cis-1, 4-polybutadiene (trade name "BR-01") available from JSR Co., Ltd.
*2: High-cis-polyisoprene (trade name "IR2200") available from JSR Co., Ltd.

TABLE 2

| Center composition | Amount (parts by weight) |
|---|---|
| BR-01 *1 | 100 |
| Zinc acrylate | 25 |

TABLE 2-continued

| Center composition | Amount (parts by weight) |
|---|---|
| Zinc oxide | 13.18 |
| Antioxidant *2 | 0.5 |
| Barium sulfate | 10 |
| Dicumyl peroxide | 1.65 |

*1: High-cis-1, 4-polybutadiene (trade name "BR-01") available from JSR Co., Ltd.
*2: Antioxidant (trade name "Yoshinox 425") available from Yoshitomi Pharmaceutical Ind., Ltd.

For the resulting two-layered core, releasability from a mold after molding, and adhesion between the core outer layer and the center were evaluated or measured, and the results are shown in Table 4. The test methods are described later.

Production of Golf Balls (Formation of Cover)

The cover compositions shown in Table 3 were covered on the resulting two-layered core 4, followed by painting the surface to obtain three-piece solid golf balls having a diameter of 42.7 mm.

TABLE 3

| Cover compositions | Amount (parts by weight) |
|---|---|
| Hi-milan 1605 *3 | 50 |
| Hi-milan 1706 *4 | 50 |
| Titanium dioxide | 2 |
| Barium sulfate | 2 |

*3: Hi-milan 1605 (trade name), ethylene-methacrylic acid copolymer ionomer resin obtained by neutralizing with sodium ion, manufactured by Mitsui Du Pont Polychemical Co., Ltd.
*4: Hi-milan 1706 (trade name), ethylene-methacrylic acid copolymer ionomer resin obtained by neutralizing with zinc ion, manufactured by Mitsui Du Pont Polychemical Co., Ltd.

Flight distance and durability of the resulting golf ball were measured or evaluated, and the results are shown in Table 4. The test methods are as follows.

Test Method (1) Releasability

After molding the two-layered core in a mold, releasability from the mold is evaluated by the following evaluation criteria.

(Evaluation Criteria)

Good: It is easy to release from the mold without using a release agent.

Fairly good: It is able to release from the mold by coating a release agent on the mold.

Poor: It is slightly difficult to release, if a release agent is coated on the mold.

(2) Flight Performance

A No. 1 wood club (a driver) was mounted to a swing robot manufactured by True Temper Co. and the resulting golf ball was hit at a head speed of 45 m/second, carry (flight distance to the point firstly dropping on the ground) was measured.

(3) Adhesion between Core Outer Layer and Center

The resulting golf ball is cut into two equal parts, the core outer layer was separated from the center by hand, and adhesion between the core outer layer and the center is evaluated by the evaluation criteria. The evaluation criteria are as follows.

(Evaluation Criteria)

Good: The core outer layer is separated between layers.

Poor: The core outer layer is separated in the layer.

(4) Durability

A golf ball was struck against a metal board at a speed of 45 m/second, repeatedly. The durability is the number of strike until the cover of the golf ball cracks, and is indicated by an index when that of Example 1 is 100.

TABLE 4

| | Example No. | | | | | Comparative Example No. | |
|---|---|---|---|---|---|---|---|
| Test item | 1 | 2 | 3 | 4 | 5 | 1 | 2 |
| Releasability | Good | Good | Good | Good | Good | Poor | Poor |
| Carry (yards) | 230 | 229 | 230 | 229 | 229 | 231 | 230 |
| Adhesion (core outer layer/center) | Good | Good | Good | Good | Good | Good | Good |
| Durability | 100 | 95 | 105 | 90 | 90 | 103 | 97 |

As is apparent from the comparison of the physical properties of the golf balls of Examples 1 to 5 with those of the golf balls of Comparative Examples 1 to 2, the golf balls of the present invention of Examples 1 to 5 have long flight distance and excellent durability, and have good releasability from a mold because the core outer layer does not contain zinc acrylate. On the other hand, the golf balls of Comparative Examples 1 and 2 have poor releasability from a mold because the core outer layer contains zinc acrylate.

What is claimed is:

1. A method of making a multi-piece solid golf ball comprising the steps of:

(a) molding a rubber composition for a center in a spherical shape to form an unvulcanized center, (b) placing a rubber composition for a core outer layer in a mold having a semi-spherical cavity, and either semi-vulcanizing the rubber composition or heating the rubber composition to such a degree that the rubber composition neither semi-vulcanizes nor shrinks between the semi-spherical cavity and a male plug mold to form a semi-vulcanized or unvulcanized semi-spherical half-shell for the core outer layer, (c) after removing the male plug mold, mounting the unvulcanized center formed in the step (a) on a concave portion of the semi-vulcanized or unvulcanized semi-spherical half-shell for the core outer layer, and covering the unvulcanized center with a semi-vulcanized or unvulcanized semi-spherical half-shell for the core outer layer separately formed in the same manner as set forth in the step (b) to integrally vulcanize and form a core, (d) optionally, repeating the step (c) to form a core having multiple core outer layers, and (e) covering the core with a cover, wherein the rubber composition for the core outer layer does not contain a zinc salt of an unsaturated carboxylic acid and the rubber composition for the center contains a zinc salt of an unsaturated carboxylic acid.

2. The method according to claim 1, wherein the core outer layer contains 100 parts by weight of a base rubber of which not less than 80% by weight is polybutadiene rubber containing a cis-1,4 bond of not less than 80%, and 5 to 50 parts by weight of a metal salt other than a zinc salt of an unsaturated carboxylic acid or ester of an unsaturated carboxylic acid.

3. The method according to claim 2, wherein the core outer layer is less than 50% by volume based on a total volume of the core.

4. The method according to claim 2, wherein the metal salt of an unsaturated carboxylic acid is a magnesium salt of an unsaturated carboxylic acid.

5. The method according to claim 1, wherein the core is composed of a center and at least one core outer layer formed on the center, and a cover covering the core, wherein the core outer layer is formed from a rubber composition which contains a metal salt of an unsaturated carboxylic acid, wherein said metal is selected from the group consisting of sodium, magnesium, tin, titanium, and zirconium.

* * * * *